United States Patent [19]

Hayakawa et al.

[11] Patent Number: 4,910,721

[45] Date of Patent: Mar. 20, 1990

[54] ELECTRONIC WATCH

[75] Inventors: Motomu Hayakawa; Osamu Miyazawa; Osamu Takahashi, all of Suwa, Japan

[73] Assignee: Seiko Epson Corporation, Tokyo, Japan

[21] Appl. No.: 338,661

[22] Filed: Apr. 17, 1989

[30] Foreign Application Priority Data

Apr. 18, 1988 [JP] Japan ..... 63-95103
May 27, 1988 [JP] Japan ..... 63-130534

[51] Int. Cl.[4] ..... G04C 15/00; G04C 9/00

[52] U.S. Cl. ..... 368/155; 368/168; 368/157; 368/149; 368/187

[58] Field of Search ..... 368/157, 155, 168, 149, 368/184, 185, 186, 190, 200, 201, 202

[56] References Cited

U.S. PATENT DOCUMENTS 3,961,213 6/1976 Koike et al. ..... 368/168

3,978,654 9/1976 Koike et al. ..... 368/155

*Primary Examiner*—Bernard Roskoski

*Attorney, Agent, or Firm*—Blum Kaplan

[57] ABSTRACT

A timepiece includes a hairspring for storing the energy provided by a step motor driving circuit and a rotor immersed in a viscous fluid controls the energy released by the hairspring to provide a constant driving force for turning the display hands of the timepiece. A frequency divider circuit counts the number of clock signals produced by an oscillator. During time correction when the hands are prevented from being driven by the energy stored in the hairspring the frequency divider retains at least a portion of the count. A recoil torque provided by the hairspring and a load torque provided by the rotor are substantially balanced at all times including immediately after the time correction activities. Time delay especially immediately following the time correction activities is avoided.

33 Claims, 9 Drawing Sheets

ELECTRONIC WATCH

BACKGROUND OF THE INVENTION

This invention relates to a timepiece, and more particularly to compensating for delays in the second hand movement of a timepiece following time correction activities.

When correcting the time of a step driven or sweep driven electronic watch, a second hand of the watch is prevented from moving by pulling a winding stem of the watch outwardly. Generation of motor driving pulses is also halted. Typically, the second hand is stopped at its zero second position (i.e. with the second hand over the numeral 12 on the face of the watch) based on generally accurate information provided by a radio, television or the like. Following time correction, the winding stem is pushed inwardly. Approximately one second is required after the winding stem has been pushed inwardly before the first of the motor driving pulses is once again generated.

A second hand readjustment type device for readjusting a driving shaft and a driven shaft of a sweep driven watch employing a magnetic coupling mechanism and viscous member is disclosed in Japanese Patent Laid-Open No. 87066/75. Another device for readjusting a wheel train on a driven shaft side of a watch is disclosed in Japanese Patent Laid-Open No. 161581/87. The first of the motor driving pulses produced after time correction activities have been completed in these devices occurs approximately one second later assuming a motor driving frequency of 1 Hz and 1/N second later when the motor driving frequency is N Hz.

Conventional sweep driven watches require the winding up of an energy storage member such as a hairspring or the like by a step motor. A balancing of forces between a recoil torque produced by the hairspring and a load torque generated by member (e.g. a rotor) within a viscous fluid (e.g. oil) provides smooth second hand movement. More particularly, the oil rotor generates a load torque proportional to angular velocity which resists changes in the recoil torque produced by the hairspring. The load torque increases as the recoil torque increases and decreases as the recoil torque decreases. The angular velocity of the hairspring as it recoils is relatively constant.

The hairspring is connected to the second hand through a wheel/gear train. A smooth sweeping motion of the second hand results. To maintain a uniform sweeping motion of the second hand, the recoil torque of the hairspring is reinforced by a predetermined periodic driving force produced by a step motor supplied to the hairspring. The recoil torque of the hairspring and the load torque of the oil rotor are generally balanced at all times.

An imbalance between the recoil torque of the hairspring and the load torque of the oil rotor, however, occurs immediately following time correction of the watch. In particular, the balance between these two torques fluctuates due to the periodicity of energy fed to the hairspring from the step motor being disturbed. A change in the angular velocity of the second hand results. Once the imbalance passes, that is, once energy is again fed on a uniform periodic basis to the hairspring the second hand will resume rotating at a constant angular velocity. Generally, during the imbalance between the recoil torque and load torque, the variation in the angular velocity of the second hand movement causes the second hand to move at a slower than real time rate. Therefore, the time displayed by the watch is incorrect. The time inaccuracy is particularly conspicuous at the time of correction.

For example, assume the winding stem of a watch is pulled out 0.8 second after the generation of a driving pulse by a step motor having a driving frequency of 1 Hz. The wheel train connected to the drive shaft of the hairspring is readjusted to correct the displayed time. As long as the winding stem is pulled out, the stored energy within the hairspring remains constant. Once the winding stem is pushed in following time correction of the watch, the hairspring gradually recoils. Approximately one second after the winding stem has been pushed in, a driving pulse from the motor is generated. Sweep movement of the second hand results. The hairspring has received driving pulses 0.8 second prior to the winding stem being pulled out and one second after the winding stem is pushed in, that is, an interval of 1.8 second between driving pulses. To maintain a balance between the recoil torque and the load torque, however, the driving pulses need to be provided to the hairspring every 1.0 seconds. The additional 0.8 seconds during which no driving pulse is provided to the hairspring results in a torque imbalance. The angular velocity of the second hand temporarily decreases resulting in the time displayed by the watch being incorrect. Once balance is restored between the recoil torque and load torque, the second hand resumes its smooth movement. Nevertheless, the time displayed by the watch is now incorrect.

When the motor driving frequency is 1 Hz, the time delay will be no greater than 1 second. Sweep driven watches using the foregoing coupling mechanism are not limited to motor driving frequencies of 1 Hz and can arbitrarily choose other motor driving frequencies which can result in greater time delays. These time delays are also due, in part, to the reduction ratio of the wheel train employed within the watch. Generally, when the motor frequency is N Hz, the time delay is no greater than 1/N seconds. The lower the motor frequency, the more conspicuous the time delay becomes.

It is therefore desirable to provide a timepiece having a second hand sweep-driven movement in which accurate time correction can be made and maintained by balancing the recoil torque of the hairspring and the load torque of the oil rotor at all times and especially immediately after time correction activities have been completed.

SUMMARY OF THE INVENTION

Generally speaking, in accordance with the invention, a timepiece includes an oscillator for producing clock signals and a frequency divider circuit for counting the number of clock signals received from the oscillating circuit and for producing a driving input signal based on the number of clock signals counted. A rotor of a step motor produces a mechanical driving force based on a motor driving circuit receiving the driving input signals intermittently. A hairspring stores energy associated with the mechanical driving force and produces a torque based on the stored energy. A rotor immersed in a viscous fluid controls the production of the torque at a relatively constant level. The hands of the timepiece rotate based on the torque. A lever within the timepiece is operable during a readjustment period for preventing the hands from rotating based on the torque.

The frequency divider circuit includes more than one ½ divider for retaining at least a portion of the count at the time that the lever prevents rotation of the hands based on the torque. In one embodiment of the invention, the count value at the beginning of the readjustment period is retained in each of the half dividers. Alternatively, only the last ½ divider within the frequency divider circuit retains its count value during the readjustment period.

By retaining a portion or all of the count value of the frequency divider circuit during the readjustment period, the recoil torque provided by the hairspring and the load torque provided by the rotor immersed in the viscous fluid are substantially balanced at all times and particularly immediately following the readjustment period. Perceptible time lag/deviation immediately following time correction activities is avoided.

Logic circuitry can be provided to inhibit the production of clock signals by the oscillator during the readjustment period or for inhibiting the supply of clock signals to the frequency divider circuitry during the readjustment period. The logic circuitry also sets one or more of the ½ dividers during the readjustment period to maintain a portion of the count stored in the ½ divider.

Efficiency in testing the timepiece during manufacture, after shipping or the like is increased by providing a test circuit which initializes the count value of the frequency divider circuit during testing.

In another aspect of the invention, the timepiece resets and sets different ½ dividers of the frequency divider circuit. In one preferred embodiment of the invention, the readjustment period is longer than the period during which the ½ dividers are reset and set. The lever which prevents rotation of the hands is also operable for causing the timepiece to reset and set the ½ dividers.

The mechanical driving force produced by the rotor occurs in less than 1/N seconds immediately after the readjustment period has been completed wherein N represents the frequency of the driving input signal produced by the frequency divider circuit. Consequently, any time lag immediately following time correction activities is imperceptible to a user.

Accordingly, it is an object of the invention to provide an improved timepiece which provides an accurate display of time especially following time correction activities.

It is another object of the invention to provide an improved timepiece which maintains a balance between the recoil torque of a hairspring and the load torque of an oil rotor immediately following time correction activities.

It is a further object of the invention to provide an improved timepiece which can be efficiently tested to ensure that the timepiece will display the correct time following time correction activities.

Still other objects and advantages of the invention will in part be obvious and will in part be apparent from the specification.

The invention accordingly comprises several steps in a relation of one or more such steps ;with respect to each of the others, and the apparatus embodying features of construction, a combination of elements and arrangements of parts which are adapted to effect such steps, all is exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings in which:

FIG. 4(*b*) is a plan view of several components shown in FIG. 4(*a*);

FIG. 4(*c*) is a fragmented sectional view of FIG. 4(*a*);

FIG. 6(*b*) is a timing chart of the signals produced by components of FIG. 6(*a*);

FIG. 7(*b*) is a timing chart of the signals produced by components of FIG. 7(*a*);

DETAILED DESCRIPTION OF THE PREFERRED EMBODIMENTS

Figure 1:
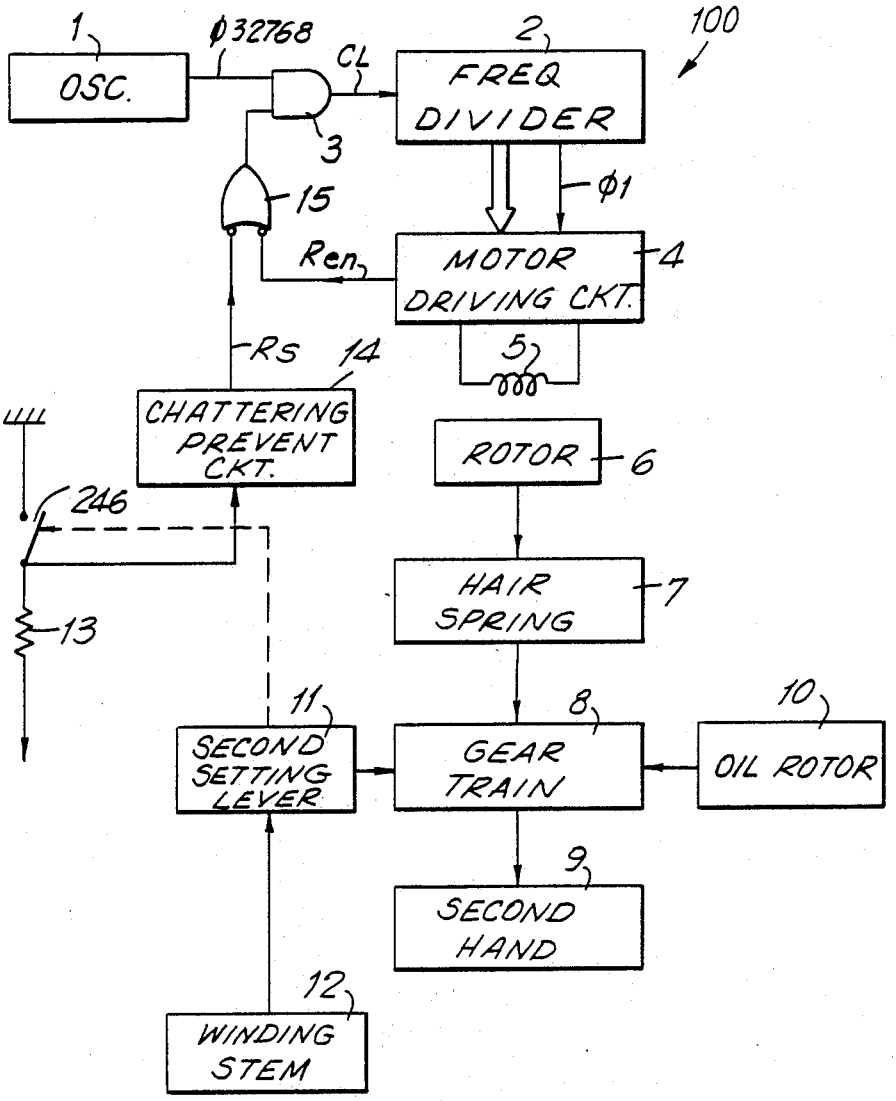
FIG. 1 is a block diagram of a sweep-driven timepiece in accordance with one embodiment of the invention.

As shown in FIG. 1, a sweep driven timepiece 100 includes an oscillator circuit 1 which generates a standard signal $\phi$32768 having a frequency of 32768 Hz. Oscillator circuit 1 includes a miniature crystal oscillator as the oscillation source. An AND gate 3 receives signal $\phi$32768 produced by oscillator circuit 1 and a signal produced by an OR gate having two negative inputs (hereinafter referred to as a NAND gate 15) and supplies a clock signal inputted to a frequency divider circuit 2. The clock signal produced by AND gate 3 is the same as signal $\phi$32768 provided the output of NAND gate 15 is at a high logic level. Frequency divider circuit 2 divides the clock signal for necessary circuit operation including an output signal $\phi$1 having a frequency of 1 Hz.

A motor driving circuit 4 generates a motor driving pulse based on the timing signals provided from frequency divider circuit 2. The motor driving pulses are applied across a coil 5 of a stepping motor. The motor driving frequency is 1 Hz. A rotor 6 rotates based on the voltage applied across coil 5 to wind-up a hairspring 7.

A second hand 9 is coupled to hairspring 7 through a gear train 8. Second hand 9 moves based on the recoil action of hairspring 7. A load torque of an oil rotor 10 is transferred to hairspring 7 through gear train 8. The load torque of oil rotor 10 is proportional to the velocity of oil rotor 10. Oil rotor 10 includes a rotor disposed within a viscous fluid such as oil. A balance between the recoil torque of hairspring 7 and load torque of oil rotor 10 permits second hand 9 to rotate in a smooth sweeping motion.

Figure 3:
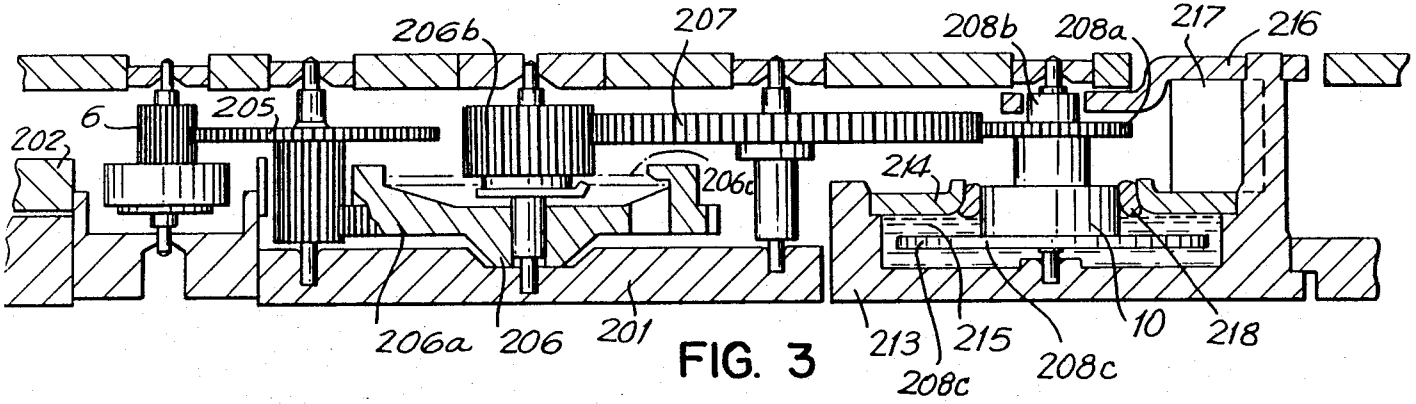
FIGS. 2 and 3 are fragmented sectional views of a sweep mechanism of the timepiece.
Figure 2:
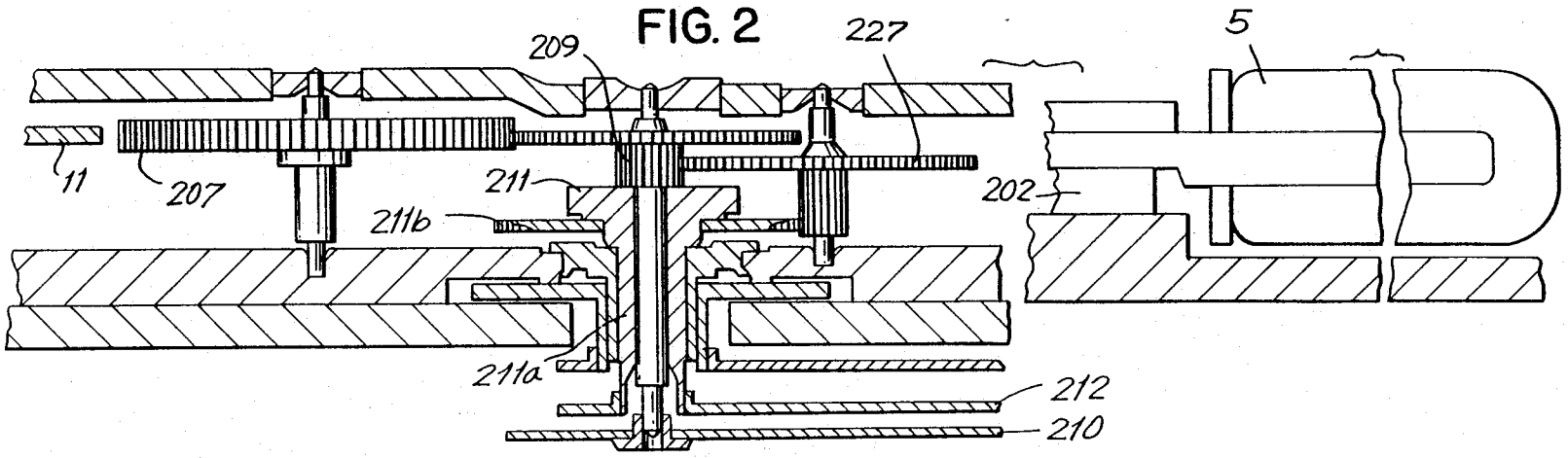
Figure 4A:
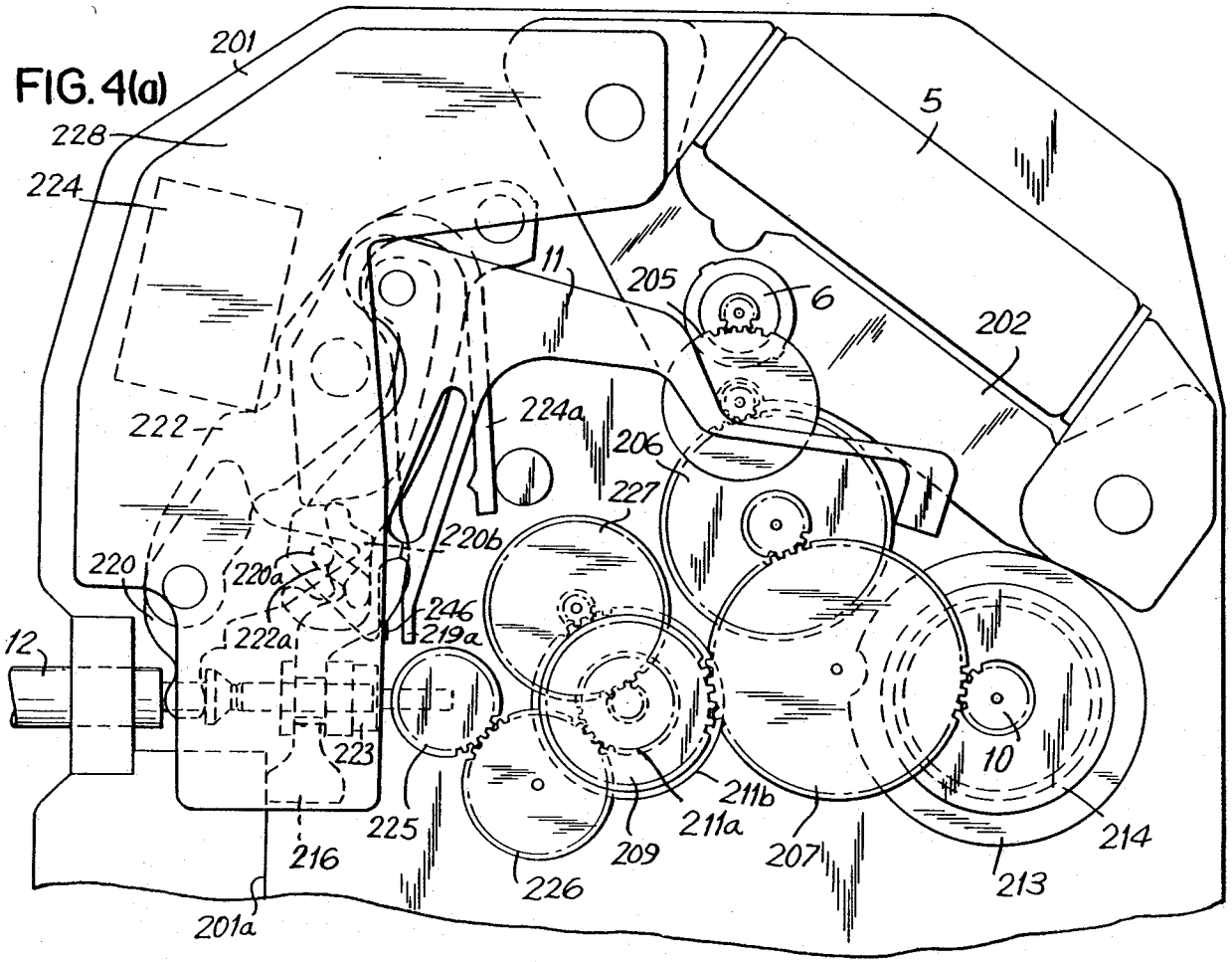
FIG. 4(*a*) is a fragmented plan view of the timepiece.
Figure 4B:
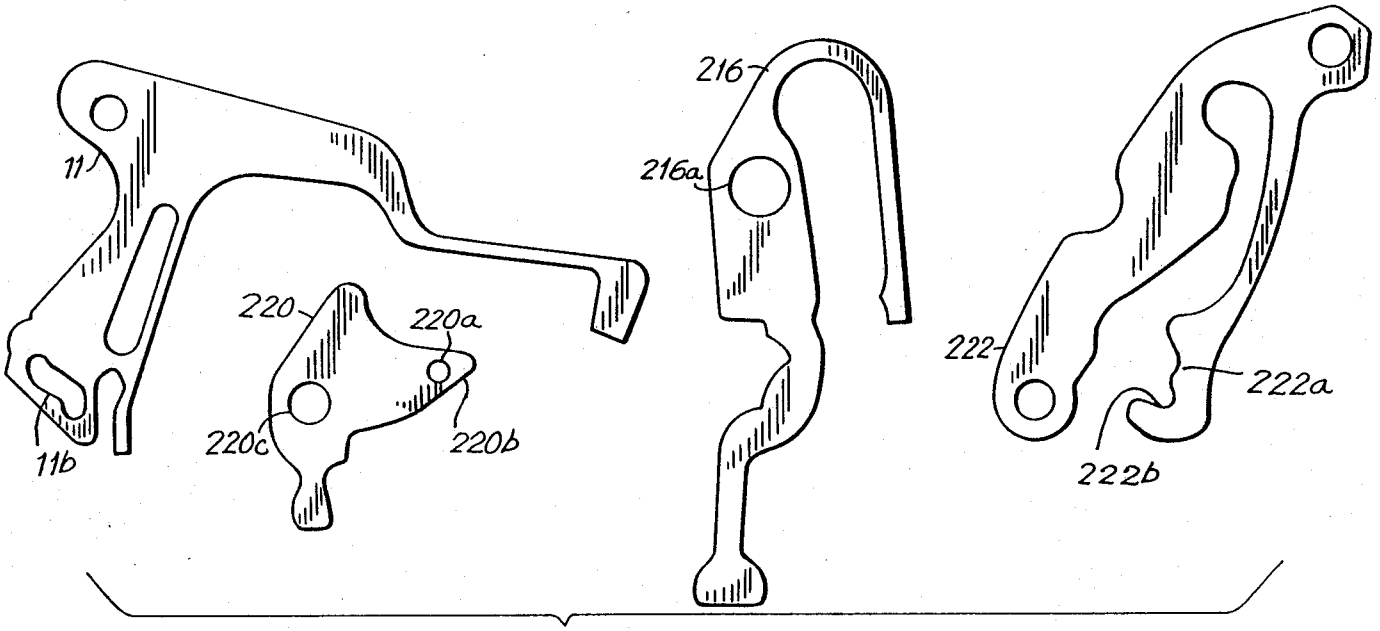
Figure 4C:
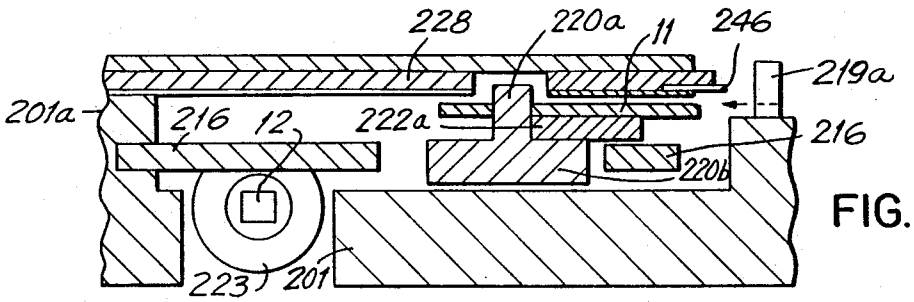

The sweep mechanism of timepiece 100 is shown in FIGS. 2, 3, 4(*a*), 4(*b*) and 4(*c*). Timepiece 100 includes a base plate 201 which supports a step motor including a stator 202, coil block 5 and rotor 6. Rotor 6 rotates 180° per second. Rotation of rotor 6 causes a fifth wheel 205 to rotate which in turn causes a transducer wheel 206 to rotate. A driving wheel 206*a* and a driven wheel 206*b* of transducer wheel 206 are coupled together through a hairspring 206*c*. Hairspring 206*c* is coupled to driving wheel 206*a* and driven wheel 206*b* so as to reduce the angle therebetween (i.e. mutual turning angle). A recoil torque of approximately 30mg mm per radian (rad) (i.e. the force associated with the mutual turning angle) is generated. Transducer wheel 206 has a rotational frequency of approximately 2.8 rpm..

An intermediate wheel 207 meshes with driven wheel 206*b*, an oil rotor pinion 208*a* and a fourth wheel 209. Second hand 9 is fixed on fourth wheel 209 and a minute hand 212 is fixed on a second wheel 211. Second wheel 211 is coupled to fourth wheel 209 through a third wheel 227 and includes a second pinion 211*a* and a second gear 211*b*. Second pinion 211*a* and second gear 211*b* will slip relative to each other when a torque of a predetermined level or greater is applied thereto.

Fourth wheel 209 rotates at approximately 1 rpm.. A reduction ratio of oil rotor pinion 208*a* to fourth wheel 209 is 2 to 1. Accordingly, oil rotor 10 has a rotational frequency of about 2.1 rpm.. The rotational frequency of rotor 6 is about 30 rpm.. The reduction ratio of rotor 6 to oil rotor 10 is about 14.

Oil rotor 10 includes oil rotor pinion 208*a*, oil rotor shaft 208*b* and an oil rotor plate 208*c*. Oil rotor plate 208*c* rotates parallel to a bottom surface of a cavity 213 within a cap 214. Cavity 213 contains a silicone oil 215. As oil rotor 10 rotates, a load torque proportional to the angular velocity of oil rotor plate 208*c* is produced based on the viscous friction between oil rotor plate 208*c* and silicone oil 215. The clearance between oil rotor plate 208*c* and the walls of cavity 213 and the viscosity of silicone oil 215 are set so that the load torque will be about 40mg mm when oil rotor 10 rotates at about 2.1 rpm..

Cap 214 and a yoke 216 are made with materials having a high magnetic permeability. Oil rotor shaft 208*b* is made from a carbon steel. Consequently, magnetic flux produced by a magnet forms a magnetic circuit passing through yoke 216, oil rotor shaft 208*b* and cap 214. A magnetic fluid 218 is draWn toward the openings between oil rotor shaft 208*b* and cap 214 and thereby prevents silicone oil 215 in cavity 213 from leaking out through these openings. The walls of cavity 213 are made from a suitable plastic and serves as an interference fit within cap 214 to prevent leakage of silicone oil 215 through the clearance between an outer periphery of cap 214 and the walls of cavity 213. The plastic chosen for the walls of cavity 213 preferably has a relatively small coefficient of thermal expansion. Leakage of silicone oil 215 at high temperatures is prevented due to the small difference in the coefficients of thermal expansion between the materials of cap 214 and the walls of cavity 213. The center hole of cap 214 has a burring finish and serves as a reservoir for magnetic fluid 218.

The driving force for stepwise rotation of rotor 6 is transferred through fifth wheel 205 to driving wheel 206*a*. Since the recoil torque stored in hairspring 7 and the load torque of oil rotor 10 are balanced, driven wheel 206*b* initially rotates at a relatively slow rate. As the recoil torque stored in hairspring 206*c* increases based on the difference in rotational frequency between driving wheel 206*a* and driven wheel 206*b*, the rotational frequency of driven wheel 206*b* increases until it reaches a constant speed of rotation of approximately 2.8 rpm. (i.e. the speed of driving wheel 206*a*). When driven wheel 206*b* is rotating at a constant speed of approximately 2.8 rpm. the angle between driven wheel 206*b* and driving wheel 206*a* is about 1 rad. (i.e. driven wheel 206*b* is wound up about 1 rad. relative to driving wheel 206*a*) and the recoil torque of hairspring 7 is about 30mg mn.

The potential energy stored in hairspring 206*c* (i.e. torque retained), however, varies before and after hairspring is wound due to driving wheel 206*a* receiving a driving step from motor driving circuit 4 before and after time correction activities. Since the load torque of oil rotor 10 changes in proportion to its angular velocity, the recoil torque retained on hairspring 206*c* as it increases results in increasing the angular velocity of oil rotor 10. An increase in the viscous load of oil rotor plate 208*c* results which opposes any increase in the angular velocity of oil rotor 10. Since oil rotor 10 is coupled through the gear train to driven wheel 206*b*, any increase in the angular velocity of driven wheel 206*b* is also opposed. Similarly, when the torque retained in hairspring 206*c* decreases any decrease in the angular velocity of driven wheel 206*b* is opposed by the viscous load on oil rotor plate 208*c*. Oil rotor 10 therefore rotates at a relatively constant speed.

When the time displayed by timepiece 100 is to be corrected, a second setting lever 11 readjusts the position of intermediate wheel 207 and substantially simultaneously comes into contact with a reset part of a circuit board 228 (discussed below). Consequently, the generation of driving pulses by motor driving circuit 4 is halted and the rotation of rotor 6 is prevented. The drive torque produced by rotor 6 and stator 202 of a conventional step motor is about 30mg mm. Employing such a conventional step motor, the torque retained by hairspring 206*c* is about 30mg mm when oil rotor 10 rotates at about 2.1 rpm. and the reduction ratio of rotor 6 to transducer wheel 206 is about 11. Hairspring 206*c* maintains its winding angle during the readjustment period. The winding angle is determined by the drive torque produced by rotor 6 and stator 202 and the position at which second setting lever 11 stops rotation of intermediate wheel 207. Once the time displayed by timepiece 100 has been corrected, second setting lever 11 is repositioned to allow intermediate wheel 207 to rotate and to move away from contact with the reset part of circuit board 228.

The positioning of second setting lever 11 for readjusting the location of intermediate wheel 207 and contacting the reset part of the circuit block is as follows. A setting lever 220 engages a groove of a winding stem 12. A projection 220*a* of setting lever 220 is positioned by a clip 222*a* of a setting lever spring 222. The center of a clutch wheel 223 has a substantially square opening and is slidable in a longitudinal direction along a square shaft of a winding stem 12. As winding stem 12 rotates, clutch wheel 223 engages the square shaft of winding stem 12 and thereby rotates in the same direction as winding stem 12. Yoke 216 is subjected to a clockwise turning force by a spring part 224a. A wall 201a of base plate 201 serves as a detent/stop for yoke 216. Yoke 224 engages a groove of clutch wheel 223 to position clutch wheel 223 as further described below. The position of second setting lever 11 is positioned based on contact with projection 220a of setting lever 220.

As winding stem 12 is pulled out (i.e. away from base plate 201) setting lever 220 is rotated about an axis 220c in a clockwise direction and projection 220a engages a next bottom crest 222b of clip part 222a of setting lever spring 222. Yoke 216 is now rotated about an axis 216a in a counter clockwise direction by a tail portion 220b of setting lever 220. Clutch wheel 223 at the same time advances to engage a setting wheel 225 on the nose tooth form. Projection 220a protrudes through and travels along an opening 11b of second setting lever 11 so as to press along the border of opening 11b. Rotation of second setting lever 11 about an axis 11a in a clockwise direction results. Second setting lever 11 contacts intermediate wheel 207 to stop rotation of the latter. At the same time, a reset spring 219a of setting lever 11 contacts a reset switch 246 of a circuit block (the state of contact not being shown) which thereby halts rotation of rotor 6.

Hairspring 206c retains the winding angle which existed just prior to the initiation of the readjustment period during the readjustment period. Following readjustment, winding stem 12 is pushed back towards base plate 201. As described below, second hand 9 begins rotation substantially immediately following the readjustment period.

During the readjustment period, that is, with winding stem 12 pulled out once, clutch wheel 223 rotates setting wheel 225 which in turn is coupled through minute wheel 226 to minute hand 212 fixed on second pinion 211a. Timepiece 100 is ready for correction (i.e. readjustment). During readjustment, intermediate wheel 207 does not rotate but rather slips between second pinion 211a and second wheel 211b. Second hand 9 is now free to be repositioned as desired for time correction. In this embodiment of the invention, intermediate wheel 207 is readjusted, however, readjustment of driven wheel 206b, fourth wheel 209, third wheel 227, second wheel 211b and oil rotor 10 also will permit second hand 9 to be freely repositioned as desired.

Referring once again to FIG. 1, when winding stem 12 is pulled out, gear train 8 is subjected to readjustment by second setting lever !!. During the readjustment, the recoil torque stored in hairspring 7 is retained. A reset switch 246 is closed resulting in a reset terminal of circuit board 228 (shown in FIG. 4) assuming a high logic level. An output signal $R_s$ produced by a chattering prevent circuit 14 assumes a high logic level. Timepiece 100 is now in a reset state, that is, timepiece 100 is now ready to receive information for purposes of time correction. Prior to reset switch 246 being closed (i.e. with reset switch 246 open) a pull-down resistor 13 serves to fix output signal $R_s$ at a low logic level. When signal $R_s$ is at a low logic level, the output of NAND gate 15 is at a high logic level. Accordingly, clock signal CL of AND gate 3 is identical to output signal $\phi 32768$ of oscillator 1. Clock signal CL is inputted to frequency divider 2. When output signal $R_s$ of chattering prevent circuit 14, however, assumes a high logic level, the output of NAND gate 15 assumes a low logic level resulting in clock signal CL changing to a low logic level. The count information stored in frequency divider circuit 2 at the point in time when output signal $R_s$ assumes a high logic level is retained by frequency divider circuit 2.

Figure 5:
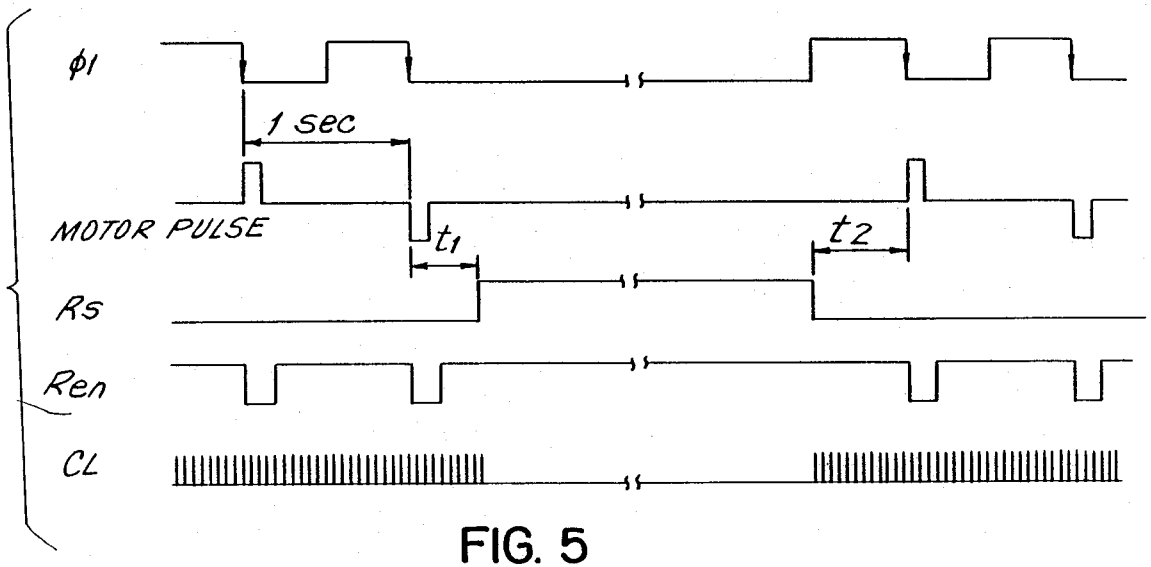
FIG. 5 is a timing chart of signals produced by components of FIG. 1.

FIG. 5 illustrates the timing of output signal $\phi 1$ of frequency divider circuit 2, the motor pulse produced by motor driving circuit 4, output signal $R_s$, clock signal CL and output signal $R_{en}$ (discussed below) relative to one another. A motor pulse is generated at time intervals of 1 second when output signal $R_s$ is at a low logic level. Each motor pulse is generated at the same time that the trailing edge of output signal $\phi 1$ of frequency divider circuit 2 occurs (i.e. the motor pulse is generated synchronously with output signal $\phi 1$). Therefore, when output signal $R_s$ is at a low logic level, the motor pulses produced by motor driving circuit 4 have the same frequency as output signal $\phi 1$ of frequency divider 2, that is, a frequency of 1 Hz.

When timepiece 100 is in the reset state, that is, output signal $R_s$ is at a high logic level, clock signal CL assumes a low logic level locking frequency divider circuit 2 at a particular count value. Motor driving circuit 4 produces no motor pulses during the reset state. When the reset state has ended by opening switch 246 output signal $R_s$ assumes a low logic level. Clock signal CL once again is identical to signal $\phi 32768$ and frequency divider circuit 2 begins counting (i.e. dividing) again. Since the count content of frequency divider circuit 2 is retained during the reset state, frequency divider circuit 2 resumes its count at the value it was at prior to the reset state.

As shown in FIG. 5, the period of time between the last motor pulse and the initiation of the reset state is represented by time $t_1$ and the period of time from the end of the reset state to the generation of the next motor pulse is represented by time $t_2$. By maintaining the sum of times $t_1$ and $t_2$ equal to 1 second, hairspring 7 receives motor pulses just prior to the reset state and just after the reset state at a normal period of 1 second excluding the period of time during which timepiece 100 is in the reset state. Since the potential energy (i.e. recoil torque) of hairspring 7 does not change during the reset state, no imbalance between the recoil torque of hairspring 7 and load torque of oil rotor 10 is created. Second hand 9 does not slow down since there is no imbalance. The correct time is displayed following time correction of timepiece 100.

Output signal $R_{en}$ is produced by motor driving circuit 4 synchronously with the generation of each motor pulse to prevent timepiece 100 from changing to a reset state during generation of the motor pulse. More particularly, at the time that each motor pulse is generated by motor driving circuit 4, output signal $R_{en}$ assumes a low logic level which prevents NAND gate 15 from producing a low logic level causing timepiece 100 to switch to a reset mode. In other words, whether or not output signal $R_s$ is at a high or low logic level during generation of each motor pulse, timepiece 100 is prevented from assuming its reset state. By preventing timepiece 100 from assuming a reset state when each motor pulse is generate, current will not continuously flow through motor coil 5. Reduction in power consumption of timepiece 100 is minimized. The reset state occurs only when output signal $R_{en}$ is at a low logic level thereby ensuring that clock signal CL is identical to output signal $\phi 32768$ until at least generation of the motor pulse is complete. Furthermore, frequency divider circuit 2 continues counting during generation of the motor pulse. A balance between the recoil torque and load torque results.

Figure 6A:
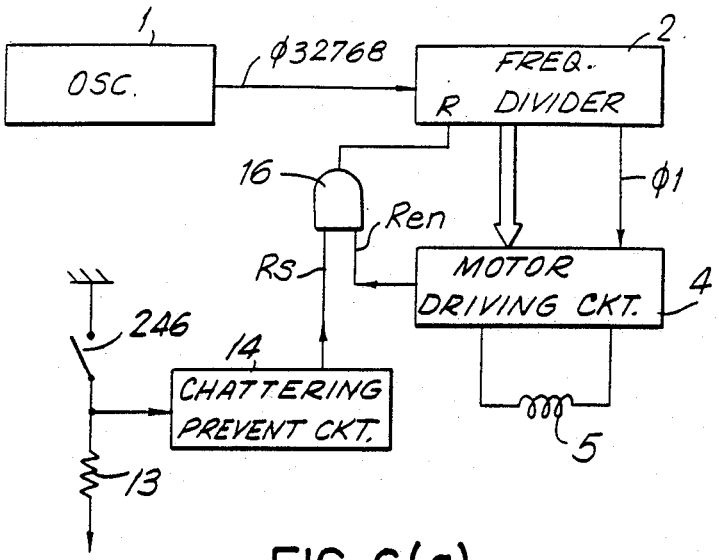
FIG. 6(a) PRIOR ART
FIG. 6(*a*) is a prior art block diagram of a sweep-driven timepiece.
Figure 6B:
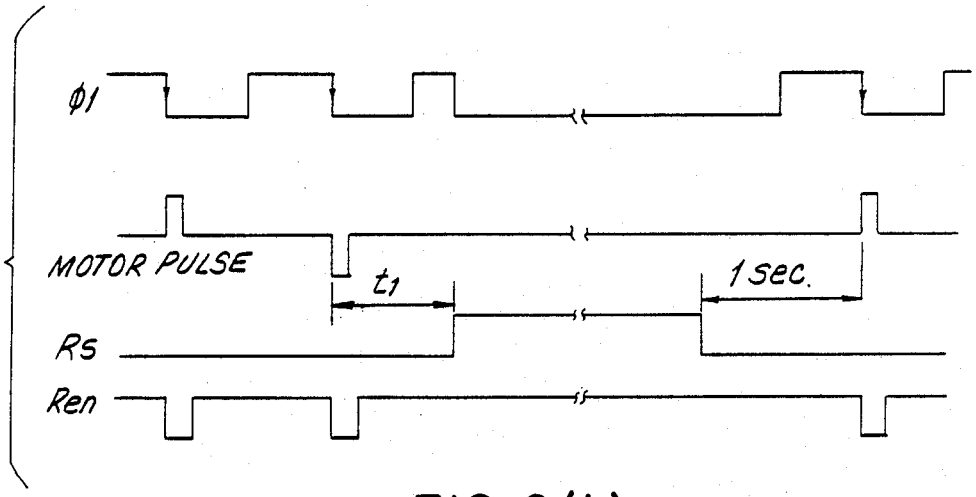
FIG. 6(b) PRIOR ART

FIG. 6(*a*) illustrates a reset block diagram of a conventional timepiece 200. Like elements are identified by the same reference numerals shown in FIG. 1. FIG. 6(*b*) illustrates the timing chart of signals $\phi 1$ produced by frequency divider circuit 2''', motor pulses produced by motor driving circuit 4 and output signals $R_s$ and $R_{en}$. When output signal $R_s$ of chattering prevent circuit 14 is at a high logic level output signal $R_{en}$ is also at a high logic level resulting in the output from AND gate 16 producing a high logic level. Frequency divider circuit 2''' is reset. Accordingly, all count values within frequency divider circuit 2''' are initialized to a low logic level.

As shown in FIG. 6(*b*), the time from a reset release (i.e. the time at which a trailing edge of signal $R_s$ occurs) to generation of the next motor pulse is 1 second. The time between the motor pulse immediately before reset actuation (i.e. the time at which a leading edge of signal $R_s$ occurs) is represented by time $t_1$. Accordingly, the effective interval between the motor pulse immediately before reset actuation and the motor pulse immediately after reset release is $1+t_1$ seconds. By excluding the reset period during which hairspring 7 receives no motor pulses, hairspring 7 receives no motor pulses for a period of $1+t_1$ seconds rather than the periodic 1 second interval. Accordingly, there exists a transistory period immediately after reset release during which second hand 9 rotates at an angular velocity which is less than its normal velocity resulting in a time deviation. The time lag can be as great: as 1 second or on the average 0.5 seconds.

Figure 9:
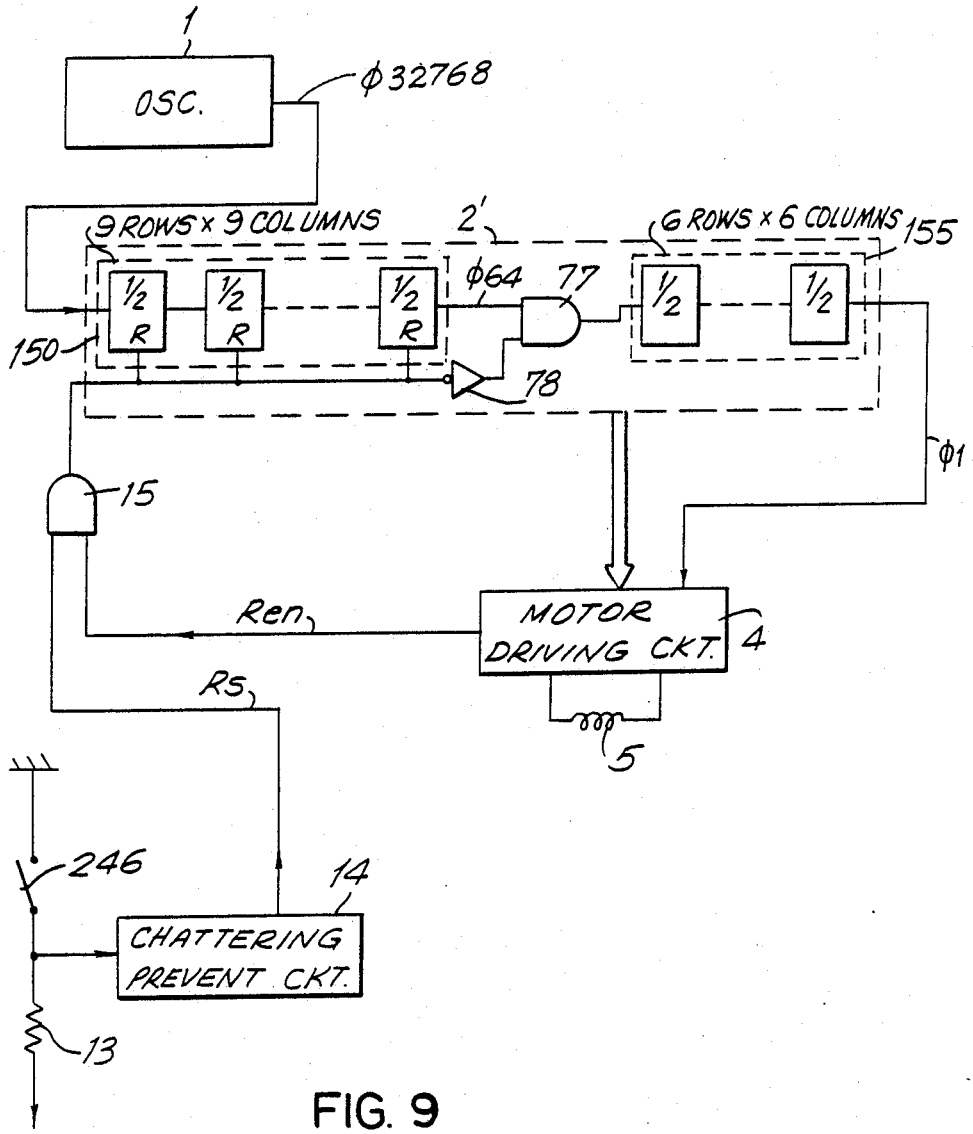
FIG. 9 is a block diagram of a sweep-driven timepiece in accordance with a further alternative embodiment of the invention.

A timepiece 300 illustrating an alternative embodiment of the invention is shown in FIG. 9 in which like elements are identified by the same reference numerals as shown in FIG. 1. A frequency divider circuit 2' includes a front stage 150 and a rear stage 155. The first nine ½ dividers represent front stage 150. The last six ½ dividers represent rear stage 155. The output of AND gate 15 is connected to the reset terminals of each of the first ½ dividers of front stage 150. Based on oscillator circuit 1 producing output signal $\phi 32768$ having a frequency of 32768, front stage 150 produces a signal $\phi 64$ having a frequency of 64 Hz. Signal $\phi 64$ serves as the clock input to rear stage 155. When the output of AND gate 15 is at a high logic level, frequency divider 2' is inhibited from producing output signal $\phi 1$. Each ½ divider of front stage 150 of frequency divider circuit 2' is initialized at a low logic level during reset (i.e. when AND gate 15 at a high logic level). Each of the ½ dividers of rear stage 155 of frequency divider circuit 2' is operable for retaining its count during reset. Accordingly, no perceptible time lag at the time of correction arises. More particularly, that portion of frequency divider circuit 2' which retains no data (i.e. is reset) is associated with delays not exceeding 1/64 of a second (15.6msec) which is beyond human detection and therefore imperceptible.

In accordance with this alternative embodiment of the invention, data is retained in only rear stage 155 of frequency divider circuit 2' rather than retaining the count value in each ½ divider of frequency circuit 2'. Data retention during the reset period of frequency divider circuit 2' car include one or more ½ dividers of rear stage 155 provided that the data retained results in a time delay which is imperceptible to a user. Accordingly, data can be retained in less than all six ½ dividers of rear stage 155 or in more than the six ½ dividers of rear stage 155 (i.e. all six ½ dividers of rear stage 155 and one or more ½ dividers of front stage 150) provided that the imbalance between the recoil torque and load torque as represented by the movement of the second hand is imperceptible to a user.

Alternatively, the nine ½ dividers of front stage 150 can be alternated between being reset and set by the output of AND gate 15 with AND gate 77 omitted so as to effectively inhibit a clock input to rear stage 155 of frequency divider circuit 2'.

Figure 10:
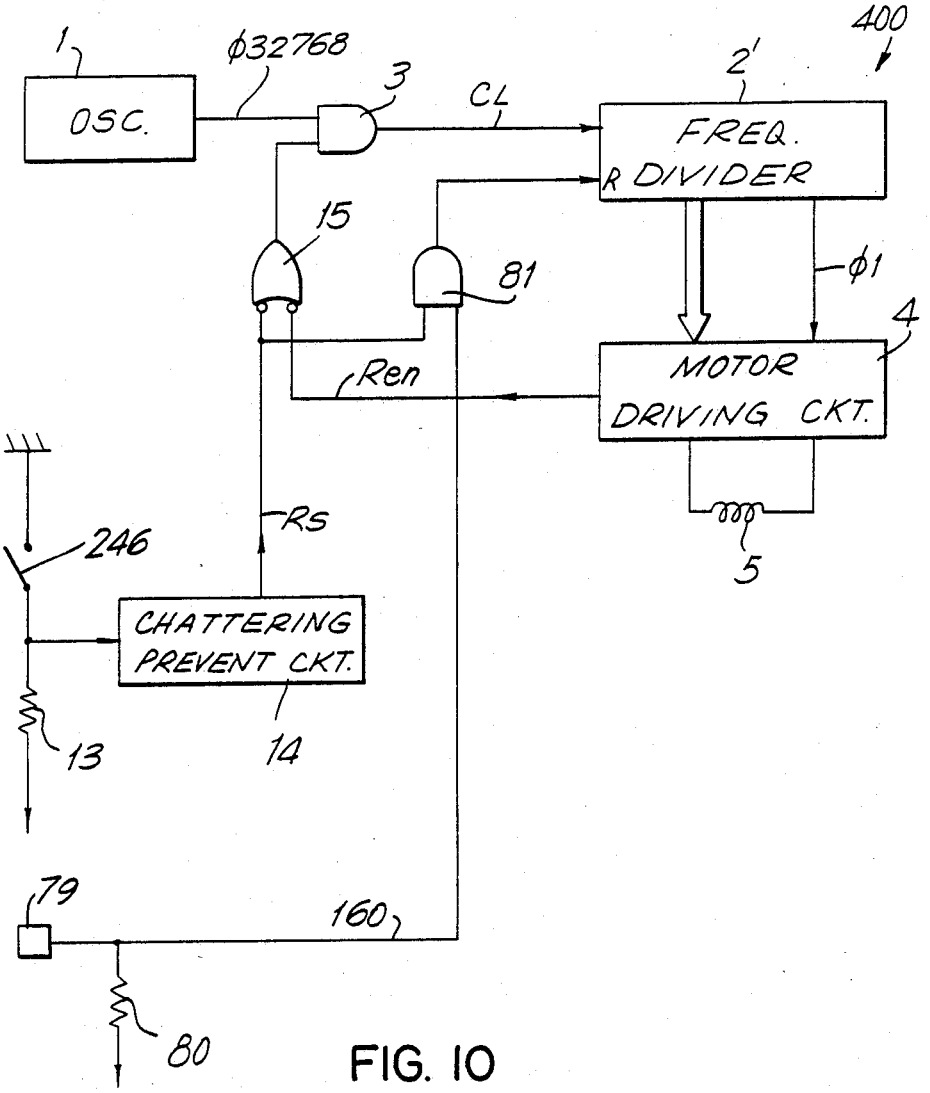
FIG. 10 is a block diagram of a sweep-driven watch in accordance with yet another alternative embodiment of the invention.

To facilitate inspection of the timepiece during the manufacturing process, shipping or the like a value of the internal counter of frequency divider circuit is initialized to a predetermined value at the time of reset actuation. By knowing the count value at the time of reset actuation, inspection of the timepiece and, in particular, the motor pulse immediately after reset release can be checked more quickly and accurately. A circuit for testing a timepiece 400 which permits the internal count of frequency divider circuit 2'''' to be initialized to a predetermined value at the time of reset actuation is shown in FIG. 10. Those elements of FIG. 10 which are similar to and operate in the same manner as in FIG. 1 are identified by like reference numerals. When a test terminal 79 is floating, a test line 160 has a low logic level based on a pull-down resistor 80 resulting in the output of an AND gate 81 is at a low logic level. Frequency divider circuit 2 is not initialized and timepiece 100 operates as described above in connection with FIG. 1. AND gate 81 changes to a high logic level when reset switch 246 is closed and test line 160 has a high logic level. The high logic level of test line 160 is provided by applying a suitable voltage to test terminal 79. Frequency divider circuit 2 now can be initialized. Consequently, by applying a suitable voltage to test terminal 79 only during the time of inspection, a more efficient inspection of timepiece 100 is realized.

Figure 7A:
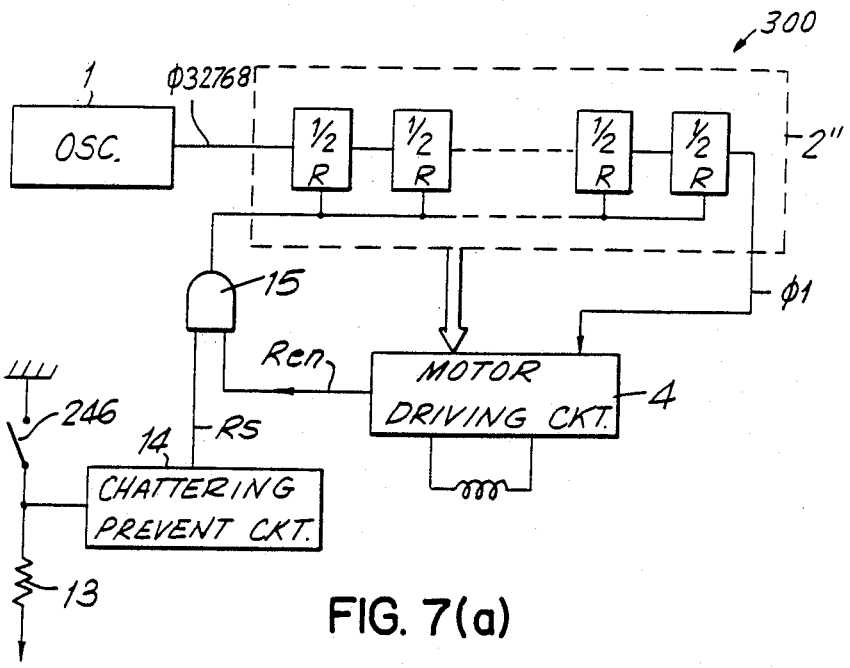
FIG. 7(*a*) is a block diagram of a sweep-driven watch in accordance with an alternative embodiment of the invention.
Figure 7B:
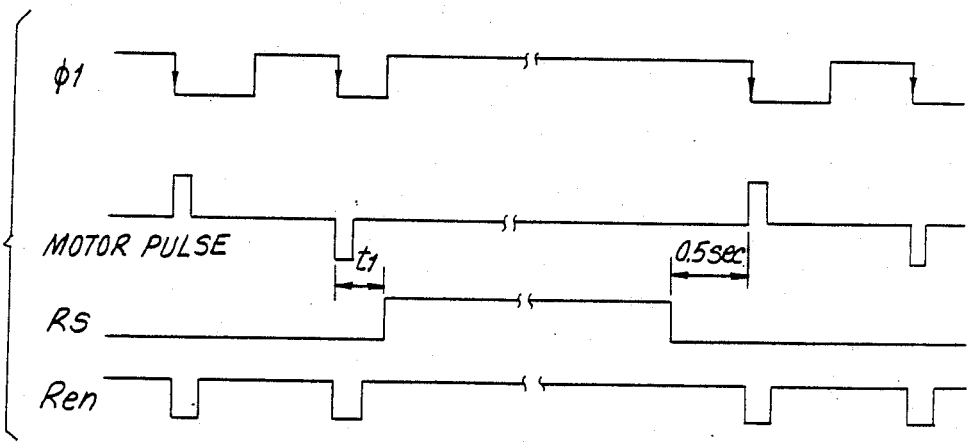

A timepiece 700 illustrating another alternative embodiment of the invention is shown in FIG. 7(*a*) FIG. 7(*b*) is a timing chart of signal $\phi 1$ produced by a frequency divider circuit 2'', the motor pulses produced by motor driving circuit 4, output signal $R_s$ of chattering prevent circuit 14 and output signal $R_{en}$ produced by motor driving circuit 4. Timepiece 300 initializes frequency divider circuit 2'' at the time of reset actuation to enhance inspection efficiency and to decrease time deviation arising from time correction of timepiece 300. In FIG. 7(*a*), an output of AND gate 15 assumes a high logic level during the reset state (i.e. output signal $R_s$ being at a high logic level). Initialization of a portion of the counter content of frequency divider circuit 2'' results. Frequency divider circuit 2'' includes a plurality of ½ dividers serially connected. A ½ divider 301 is set while all other ½ dividers are reset during the reset state of timepiece 300. Output signal $\phi 1$ of frequency divider circuit 2'' assumes a low logic level 0.5 seconds after reset release. Therefore, production of the first motor pulse after reset release occurs 0.5 seconds after the trailing edge of output signal $R_s$. The effective time interval between the motor pulse immediately before reset actuation and the motor pulse immediately after reset release is $t_1+0.5$ seconds. Considering that time $t_1$ can range from 0 to 1 seconds, the average period for providing energy to hairspring 7 is $\pm$ 0.5 seconds, that is 0 seconds on average. Accordingly, the time deviation after time correction is 0 seconds on average and 0.5 seconds at worst. In contrast thereto, a conventional timepiece has a time deviation of 0.5 seconds on average or 1 second at worst. Accordingly, timepiece 300 substantially eliminates any perceptible time lag following time correction compared to conventional timepieces.

Figure 8:
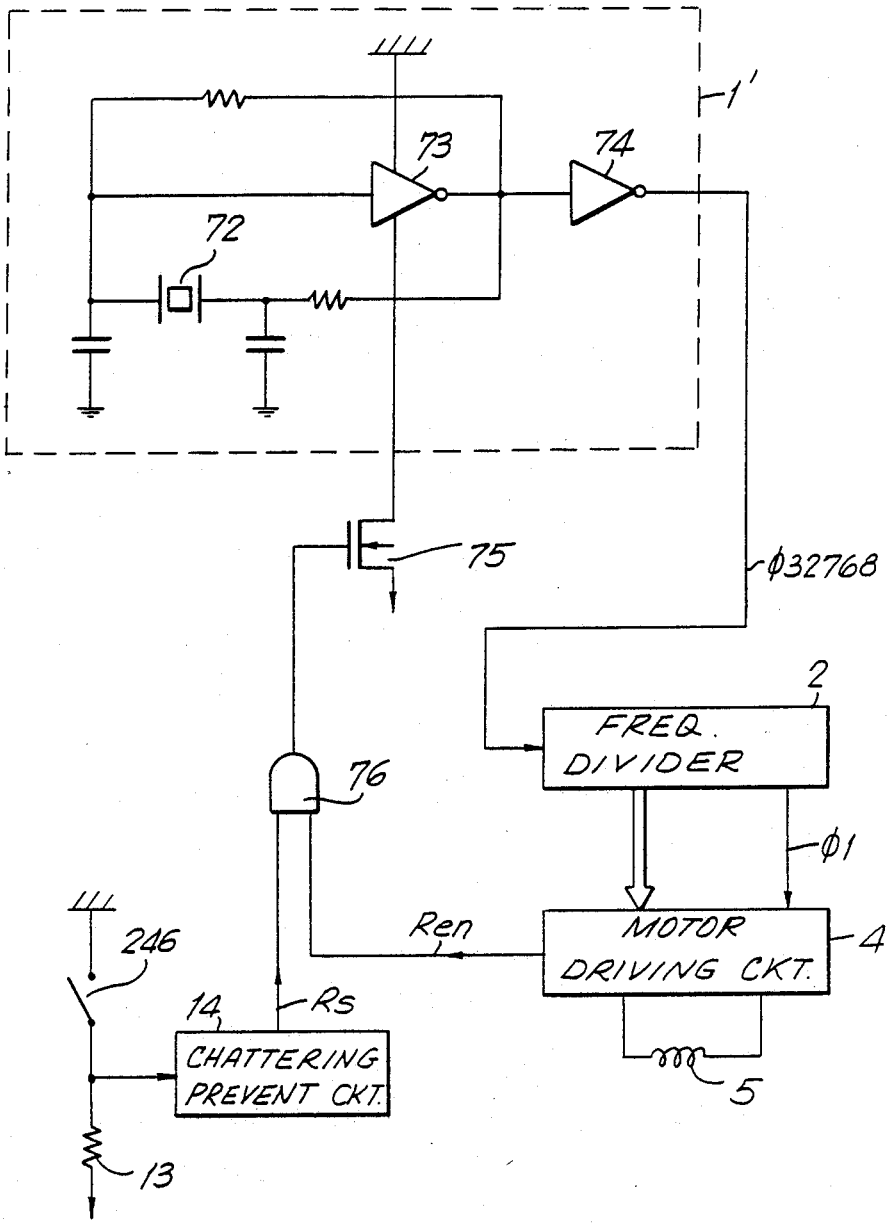
FIG. 8 is a schematic and block diagram of a sweep-driven timepiece in accordance with another alternative embodiment of the invention.

FIG. 8 illustrates a timepiece 600 in accordance with yet a further alternative embodiment of the invention. Those elements in FIG. 8 which are similar in construction and operation to elements shown in FIG. 1 are identified by like reference numerals. Oscillator 1' includes a crystal resonator 72 producing an output frequency of 32,768 Hz which serves as an oscillation source. The output signal from resonator 72 is amplified by an inverter 73. An inverter 74 provides wave shaping. Oscillator 1' produces a square wave serving as signal $\phi 32768$ which is provided to frequency divider circuit 2. A transistor 75 is operable for cutting power supplied to inverter 73 during the reset state of timepiece 600. More particularly, when both output signals $R_s$ and $R_{en}$ are at a high logic level, transistor 75 is turned off. Accordingly, oscillator 1' does not produce an oscillating signal during the reset state of timepiece 600. The internal count value of frequency divider circuit 2 is retained during the reset state. Timepiece 600 substantially eliminates any time delay as discussed above in connection with FIG. 1.

Referring once again to FIG. 7(*a*), the set/reset connections of the ½ dividers of frequency divider circuit 2'' illustrates only one of a number of different possible set/reset combinations in accordance with the invention. More particularly, by retaining at least one ½ divider set during the reset state, the time interval following reset release to generation of a motor pulse will be less than 1 second. Depending on the number and the particular ½ dividers which are set during the reset state of timepiece 700, the time delay can be varied. In any event, by providing that at least one of the ½ dividers is set during the reset state, the time deviation following time correction will be less than 1 second.

The time delay also can be changed and, in particular, lessened by changing the shape of second setting lever 11 to vary the times at which second setting lever 11 contacts readjusting gear train 8 and the reset part of the circuit block. In particular, second setting lever 11 can be shaped so that signal $R_s$ assumes a high logic level after wheel train 8 is subjected to readjustment and so that gear train 8 is released from readjustment after signal $R_s$ assumes a low logic level. In other words, the period of time in which gear train 8 is readjusted is longer than the time in which signal $R_s$ is at a high logic level. The effective time interval between occurrences of the motor pulse immediately before the reset state and the motor pulse immediately after the reset state is reduced. Time lag of second hand 9 is minimized.

In the foregoing embodiments, the motor pulse output frequency has been 1 Hz. Other frequencies can be chosen according to the construction of the sweep driven timepiece including the desired reduction ratio of gear train 8 which affects the movement of second hand 9. Therefore, the invention is not limited to only motor pulse output frequencies of 1 Hz. Imperceptible delays in the movement of second hand 9 can be achieved at other arbitrary frequencies.

Figure 11:
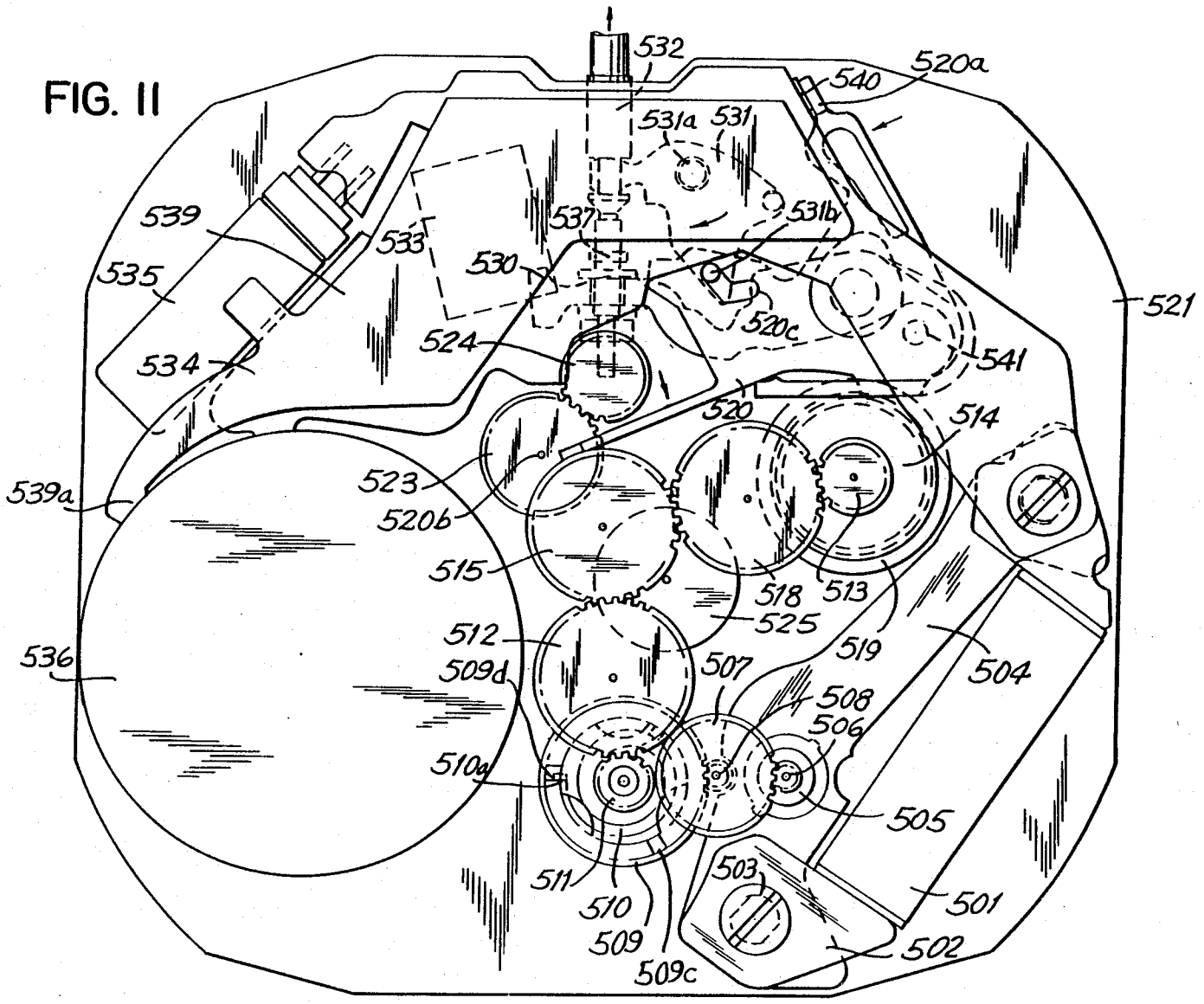
FIG. 11 is a plan view of a timepiece in accordance with still another alternative embodiment of the invention.

FIG. 11 illustrates a timepiece 500 in accordance with a further alternative embodiment of the invention. A hairspring 510 is wound in a direction for expansion based on the rotation of a hairspring 509. Hairspring 510 rotates in a direction from an outer diameter side toward an inner diameter side of hairspring wheel 509. Hairspring wheel 509 includes a nose having a bend 510*a* which engages with a groove 509*c*. The diametrical position of the nose is regulated by a wall 509*d*. A viscous rotor 514 is subjected to a load from a viscous fluid 517 to control rotation of viscous rotor 514. Timepiece 500 includes a base plate 521 and a wheel train bearing (not shown). A coil 501 generates a magnetic field for driving a rotor 505 through a stator 504. A magnetic core 502 is fixed by a screw 503 to base plate 521. Viscous fluid 517 is held within a container 519. The reduction ratio cf the gear train is obtained through a sixth pinion 506, a fifth gear 507 and a fifth pinion 508 which also isolates rotor 505 from hairspring 510 to avoid any adverse influence due to magnetic forces. Hairspring wheel 509 drives a hairspring pinion 511 through coupling of hairspring 510 therebetween. A fourth wheel 515 is rotatingly coupled to a fourth idler 512 which is driven by hairspring pinion 511. A pointer (not shown) is coupled to a fourth wheel 515. A viscous rotor intermediate wheel 518 is coupled to viscous rotor 514 for applying braking action to fourth wheel 515. The foregoing construction of timepiece 500 permits timepiece 500 to be assembled in an advantageous manner as described below.

Hairspring pinion 511, fourth idler 512 and fourth wheel 515 are disposed linearly relative to each other to prevent fourth idler 512 from falling away from engagement with hairspring pinion 511 and fourth wheel 515 during assembly. Fourth wheel 515, viscous rotor id) ®r 518 and viscous rotor pinion 513 are also disposed linearly relative to each other to prevent viscous rotor idler 518 from falling away from fourth wheel 515 and viscous rotor pinion 513 during assembly. Fourth wheel 515 is subjected to both a braking action produced by the load torque on the oil rotor collar side of fourth wheel 515 and to a driving force produced by the recoil torque on the hairspring side of fourth wheel 515. Accordingly, it is preferable that viscous rotor idler 518 and fourth idler 512 overlap fourth wheel 515 to reduce any torque from decreasing side pressure exerted on fourth wheel 515. It is also preferable that viscous rotor idler 518 and fourth idler 512 be positioned opposite each other for decreasing any fluctuations which might tend to boost the pointer. The construction of timepiece 500 results in the side pressure and boost being almost orthoganol to each other and in the driving force and braking force resulting in a torque being applied to fourth wheel 515 which is in the same direction as the force applied by a second setting lever 520 at the time of readjustment. Accordingly, the gear train is laid out so that a tenon is pushed in only one direction to suppress any fluctuations which may cause a member to be boosted.

Hairspring gear 509 and stator 504 are prevented from overlapping each other by fifth gear 507 and fifth pinion 508. By coupling hairspring pinion 511, fourth idler 512, fourth wheel 515, viscous rotor intermediate wheel 518 and viscous rotor pinion 513 together to form a row overlapping sectionally of the same is avoided. Consequently, the components of timepiece 500 can be assembled to produce a relatively thin timepiece.

Assembly of &:he pointer (i.e. second hand), hairspring pinion 511, fourth idler 512, viscous rotor idler 518 and viscous rotor pinion 513 is simply and easily accomplished. A small second hand type watch can be easily built. A stud wheel 523 drives an hour hand (not shown). A pinion 524 is operable for engagement with a clutch wheel 537 which in turn is operable for engagement with a setting lever 531 and a yoke 530 based on the position of a winding stem 532. Correction of the hour hand and minute hand through this arrangement are easily and simply achieved. A third wheel 525 is coupled to fourth wheel 515 for driving a minute hand (not shown). Third wheel 525 rotates at a slower rate than fourth wheel 515. An integrated circuit 533 includes a clock circuit. A crystal resonator 535 supplies the oscillating frequency to integrated circuit 533 for forming a driving waveform supplied to rotor 505 of the stepping motor through a circuit board 534 and coil 501. Energy for integrated circuit 533 is supplied by a battery 536.

Second setting lever 520 rotates about a center 541. Integrated circuit 533 includes a reset terminal 540 for resetting integrated circuit 533. During reset integrated circuit 533 is electrically disconnected from the positive terminal of battery 536. Once in the reset state, current is nc longer supplied to coil 501. Rotor 505 no longer rotates. A projection **539*a* connects a circuit retainer 539 to the positive terminal of battery 536. Second setting lever 520 also can contact battery 536 at projection 539*a* based on the pivotal position of a setting lever 531 pivoting about a setting lever axle 531*a*. Setting lever 531 includes a guide dowel/boss 531*b*. Second setting lever 520 includes a contact 520*a* and a readjusting part 520*b*. As winding stem 532 is pulled outwardly in a direction denoted by an arrow A, second setting lever 520 rotates about center 541 and is guided by guide boss 531*b* of setting lever 531. Readjusting part 520*b* contacts a reset terminal 540 and readjusting part 520*b* readjusts fourth wheel 515 to stop rotation of the latter. Second setting lever 520 is made of an electrically conductive material. With winding stem 532 pulled out the positive terminal of battery 536 is applied to reset terminal 540 through second setting lever 520. The winding angle of hairspring 510 does not fluctuate during the reset state since mechanical readjustment by readjusting part 520*b* and the electrical reset of the frequency divider circuit by contact 520*a*** occur at about the same time.

It is difficult, however, to ensure that contact **520*a* contacts reset terminal 540 at exactly the same time that readjusting part 520*b* stops rotation of fourth wheel 515. Therefore, it is preferable that mechanical readjustment occur first when rotor 505 rotates only after a time delay following reset release. More particularly, by providing that mechanical readjustment occurs prior to electrical reset (i.e. reset actuation) the winding angle of hairspring 510 will store more potential energy than when mechanical readjustment and electrical reset occur simultaneously. This additional potential energy can be used to compensate for the delay in driving rotor 505 after reset release. When rotor 505 is driven substantially simultaneously with the occurrence of reset release, it is preferable to have electrical reset occur before mechanical readjustment to prevent deformation of hairspring 510. Such deformation can be caused by an increase in winding angle at the time of reset release. Therefore, deviation between the times at which resetting of the electrical circuitry occurs and rotation of rotor 505 halts does not create the impression to a user that a time delay or advance following the time of readjustment release has occurred. Rotor 505 is actuated at a time corresponding to a ½ step after reset release. The timing at which resetting of the electrical circuitry occurs is shifted so that deviation in the timing between resetting of the electrical circuitry and driving of rotor 505** is corrected at the time of start-up.

The operation of timepiece 500 has been based on readjustment of fourth wheel 515. If this readjustment is carried out with potential energy stored in hairspring 510, the second hand will be ready for continuous movement at the time of readjustment release. Alternative constructions of timepiece 500 can be employed by retaining the potential energy stored in hairspring 505 during the reset state. Hairspring wheel 509 turns intermittently with hairspring pinion 511 serving as a shaft. Application of a driving force to hairspring wheel 509 rotates hairspring 511 due to static friction therebetween. Consequently, the second hand rotates substantially at the same time as hairspring wheel 509 begins to rotate following readjustment release.

As now can be readily appreciated, the invention ensures that energy is supplied to a hairspring on a periodic basis and, in particular, that the effective period for supplying energy to the hairspring is not disturbed due to time correction of the timepiece. The recoil torque of the hairspring and load torque of the oil rotor are effectively balanced at all times. Such balance does not change due to time correction. To ensure that there is no disturbance in the effective period during which energy is supplied to the hairspring, gate circuitry is provided to inhibit a clock input to a frequency divider circuit at the time of reset actuation. Alternatively, inhibiting a clock input to a frequency divider circuit can be obtained through switching which cuts the supply of power to an oscillator circuit to prevent reduction of an oscillating frequency generated by the oscillator. The second hand of the timepiece can immediately begin its sweeping motion at a normal angle immediately following time correction. Transient deterioration in the angular velocity of the second hand is prevented following reset release. The timepiece accurately displays the correct time following time correction. The circuit load during the reset state is also minimized reducing power consumption and thereby prolonging the life of the battery. During testing of the timepiece, the frequency divider circuit can be initialized to a specific value in order to efficiently inspect the timepiece.

It will thus be seen that the objects set forth above and those made apparent from the preceding description are efficiently attained and, since certain changes may be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

What is claimed is:

1. A timepiece comprising:

oscillating means for producing clock signals;

frequency divider means for counting the clock signals and for producing a driving input signal based on the number of clock signals counted;

driving means for producing a mechanical driving force based on said driving input signal;

storage means for storing energy associated with said mechanical driving force and for producing a torque based on said stored energy;

first control means for controlling the production of said torque at a relatively constant level;

indicator means operable for rotatingly indicating the time based on said torque; and readjustment means operable during a readjustment period for preventing said indicator means from rotating based on said torque;

wherein said frequency divider means includes holding means for retaining at least a portion of the count during said readjustment period.

2. The timepiece of claim 1, further including gate means for inhibiting the counting of said clock signals by said frequency divider means.

3. The timepiece of claim 1, further including second control means for preventing production of said clock signals by said oscillating means.

4. The timepiece of claim 1, further including second control means for controlling the operative and non-operative states of said frequency divider means.

5. The timepiece of claim 1, wherein said storage means includes a hairspring.

6. The timepiece of claim 2, wherein said storage means includes a hairspring.

7. The timepiece of claim 3, wherein said storage means includes a hairspring.

8. The timepiece of claim 4, wherein said storage means includes a hairspring.

9. The timepiece of claim 1, wherein said control means include a rotor immersed within a viscous fluid.

10. The timepiece of claim 2, wherein said control means includes a rotor immersed within a viscous fluid.

11. The timepiece of claim 3, wherein said control means includes a rotor immersed within a viscous fluid.

12. The timepiece of claim 4, wherein said control means includes a rotor immersed within a viscous fluid.

13. The timepiece of claim 5, wherein said control means includes a rotor immersed within a viscous fluid.

14. The timepiece of claim 1, further including testing means for initializing the count of said frequency divider means to a predetermined value.

15. The timepiece of claim 1, wherein said driving signal has a frequency of N hertz and said frequency divider means includes means for supplying said driving input signal intermittently to said driving means.

16. A timepiece comprising:

oscillating means for producing clock signals at a first frequency;

frequency divider means for counting the clock signals and for producing a driving input signal at a second frequency of N hertz based on the number of clock signals counted, said first frequency being greater than N hertz;

driving means for producing a mechanical driving force based on said driving input signal;

storage means for storing energy associated with said mechanical driving force and for producing a torque based on said stored energy;

first control means for controlling the production of said torque at a relatively constant level;

indicator means operable for rotatingly indicating the time based on said torque;

readjustment means operable during a readjustment period for preventing said indicator means from rotating based on said torque; and second control means for causing said frequency divider means to retain at least a portion of the count during said readjustment period;

wherein said driving means produces a mechanical driving force in less than 1/N seconds immediately after the readjustment period has been completed.

17. The timepiece of claim 16, wherein said storage means includes a hairspring.

18. The timepiece of claim 16, wherein said first control means includes a rotor immersed in a viscous fluid.

19. The timepiece of claim 17, wherein said first control means includes a rotor immersed in a viscous fluid.

20. The timepiece of claim 16, further including testing means for initializing the count of said frequency divider means to a predetermined value.

21. A timepiece comprising:

oscillating means for producing clock signals;

frequency divider means for counting the clock signals and for producing a driving input signal based on the number of clock signals counted;

driving means for producing a mechanical driving force based on said driving input signal;

storage means for storing energy associated with said mechanical driving force and for producing a torque based on said stored energy;

control means for controlling the production of said torque at a relatively constant level;

indicator means operable for rotatingly indicating the time based on said torque;

readjustment means operable during a readjustment period for preventing said indicator means from rotating based on said torque; and reset means operable during a reset period for resetting a portion of the count of the frequency divider means;

wherein said readjustment period is longer than said reset period.

22. The timepiece of claim 21, wherein said storage means includes a hairspring.

23. The timepiece of claim 21, wherein said control means includes a rotor immersed in a viscous fluid.

24. The timepiece of claim 22, wherein said control means includes a rotor immersed in a viscous fluid.

25. The timepiece of claim 21, wherein said driving signal has a frequency of N hertz and said frequency divider means includes means for supplying said driving input signal intermittently to said driving means.

26. The timepiece of claim 21, further including testing means for initializing the count of said frequency divider means to a predetermined value.

27. A method for displaying the correct time of day comprising:

generating clock signals;

counting the clock signals and producing a driving input signal based on the number of clock signals counted;

producing a mechanical driving force based on the driving input signal;

storing energy associated with the mechanical driving force and producing a torque based on the stored energy;

controlling the production of the torque at a relatively constant level;

rotatingly indicating the time based on the torque;

preventing an indicator from rotating based on the torque during a readjustment period; and retaining at least a portion of the count during the readjustment period.

28. The method of claim 27, further including inhibiting the counting of the clock signals during the readjustment period.

29. The method of claim 27, further including preventing the clock signals from being generated during the readjustment period.

30. The method of claim 27, wherein the driving input signal has a frequency of N hertz and further including producing the driving input signal intermittently.

31. The method of claim 30, wherein the mechanical driving force is produced in less than 1/N seconds immediately after the readjustment period has been completed.

32. The method of claim 27, further including resetting a portion of the count during a reset period.

33. The method of claim 32, wherein the readjustment period is longer than the reset period.

* * * * *